US006935694B2

(12) United States Patent
Turner

(10) Patent No.: US 6,935,694 B2
(45) Date of Patent: Aug. 30, 2005

(54) FOLDING SAND BEACH CHAIR

(76) Inventor: Deborah Turner, 146 Loomis Dr., Apt. B-1, West Hartford, CT (US) 06107

( * ) Notice: Subject to any disclaimer, the term of this patent is extended or adjusted under 35 U.S.C. 154(b) by 286 days.

(21) Appl. No.: 10/441,823

(22) Filed: May 20, 2003

(65) Prior Publication Data

US 2003/0230922 A1 Dec. 18, 2003

Related U.S. Application Data

(60) Provisional application No. 60/388,611, filed on Jun. 14, 2002.

(51) Int. Cl.[7] ..... B60N 2/02

(52) U.S. Cl. ..... 297/354.13; 297/900; 297/188.14

(58) Field of Search ..... 297/354.13, 900, 297/114, 112, 396, 403, 409, 353, 188.14

(56) References Cited

U.S. PATENT DOCUMENTS

| | | | | |
|---|---|---|---|---|
| 807,394 | A | | 12/1905 | McKeever, Jr. |
| 1,271,701 | A | * | 7/1918 | Griffith |
| 1,741,192 | A | * | 12/1929 | Kusterer |
| 2,651,352 | A | | 9/1953 | Beardsley |
| 3,671,983 | A | | 6/1972 | Bertolet |
| 3,828,377 | A | | 8/1974 | Fary, Sr. |
| 3,897,102 | A | | 7/1975 | Lemaire |
| 4,072,341 | A | | 2/1978 | Kurz |
| 4,108,492 | A | | 8/1978 | Kirby |
| 4,606,086 | A | | 8/1986 | Rowland |
| 4,867,505 | A | | 9/1989 | Parker |
| 4,941,222 | A | | 7/1990 | Prager |
| 5,237,713 | A | | 8/1993 | Prager |
| 5,423,592 | A | * | 6/1995 | Spurrier et al. |
| 5,611,594 | A | * | 3/1997 | Findlay |
| 5,624,157 | A | | 4/1997 | Kostuk |
| 5,893,605 | A | * | 4/1999 | Chang ..... 297/188.14 |
| 5,946,749 | A | | 9/1999 | Sewell |
| 5,947,561 | A | | 9/1999 | Ryan |
| 5,950,259 | A | * | 9/1999 | Boggs |
| 6,068,342 | A | | 5/2000 | Mariani et al. |

* cited by examiner

*Primary Examiner*—Milton Nelson, Jr.
(74) *Attorney, Agent, or Firm*—Fish & Richardson P.C.

(57) ABSTRACT

A sand beach chair formed of panels mounted to a frame includes a seat, a seatback extension pivotably mounted to the seat, and a seatback extension pivotably mounted to the seatback extension. The seatback extension is adjustable between a first, sitting position folded against the seatback and a second, horizontal position in which it defines, with the seat and seatback, an extended surface.

2 Claims, 4 Drawing Sheets

FOLDING SAND BEACH CHAIR

TECHNICAL FIELD

This application claim benefit from U.S. Provisional Application No. 60/388,611, filed Jun. 14, 2002, the entire disclosure of which is incorporated herein by reference.

The invention relates to beach chairs, and more particularly to folding sand beach chairs.

BACKGROUND

Sand beach chairs typically have relatively short legs that position the chair seat just above the beach surface so that the user sits with legs extended, e.g., for better sunning exposure.

SUMMARY

According to the invention, a sand beach chair formed of panels mounted to a frame comprises a seat, a seatback pivotably mounted to the seat for movement between a first, upright position and a second, horizontal position, and a seatback extension. The seatback extension is pivotably mounted to the seatback for selectable adjustment between a first, sitting position folded generally against the seatback and a second, horizontal position extending from the seatback to define, with the seat and seatback, an extended surface.

In a preferred embodiment, a panel of the seatback extension defines an aperture positioned for receiving a user's face in anatomically correct position when lying in the prone position.

Objectives of the invention include to provide a folding sand beach chair convertible between sitting and prone positions, the sand beach chair thus being particularly suited for use when tanning both in the sitting position and in the prone (face down) position.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1:
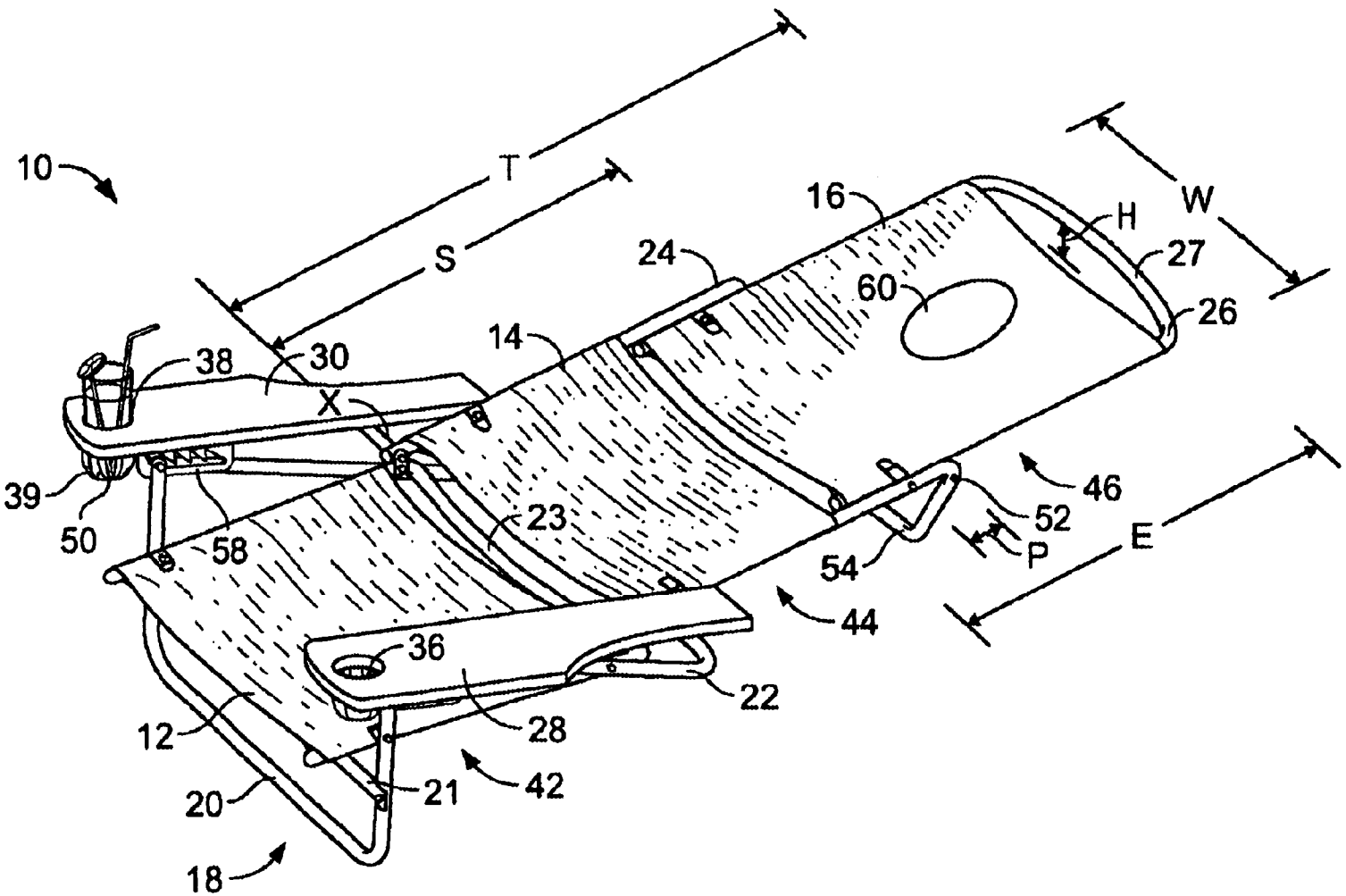
FIG. 1 is a perspective view of one embodiment of a folding sand beach chair of the invention with the seatback and extension in horizontal (prone) position.

Referring to FIG. 1, a lightweight, folding sand beach chair 10 has a seat 42, a seatback 44 adjustable between upright (sitting) position (FIG. 1) and horizontal (prone) position (FIG.2), and a seatback extension 46 pivotably mounted to the seatback 44. The sand beach chair is formed of breathable fabric panels or webbing 12, 14, 16 stretched over a frame 18 of bent aluminum tubing 20, 21, 22, 23, 24, 26, with wood arm rests 28, 30. The elements of aluminum tubing 20, 21, 22, 23 and 24 forming the sand beach chair seat 42 and seatback 44 are typically 1 inch OD (outer diameter) tubing, while the aluminum tubing 26 forming the seatback extension 46 is typically 0.875 inch OD. The outer crossbar portion 27 of aluminum tubing 26 is bowed above the plane of the seatback extension fabric to a height, H, e.g. about 2 inches. The armrests are typically formed of hardwood, e.g. ¾ inch to 1 inch thick and about 5 inches wide and 21 inches long. At the outer end of each armrest, cup holders 32, 34, e.g. 3½ inches in diameter and 4 inches deep, are provided by cup holder apertures 36, 38 defined in the armrests with cup supports 37, 39 made, e.g., of three, ¾ inch nylon straps attached to the undersurface of the armrests and joined also at their intersections 50.

In the embodiment shown, the seatback 44 has a length, S, e.g. about 26 inches, and the seatback extension 46 has a length, E, e.g. about 22 inches, and a width, W, e.g. about 18½ inches. The seatback extension 46 is mounted to pivot, about axis, P, relative to seat 42 into supporting engagement (shown in FIG. 1) with stop rod 52. In the inclined position, the crossbar portion 54 of the seatback 44 is placed in engagement with the beach surface, providing support for the cantilevered seatback extension 46. The seat back 44 and the seatback extension 46 extend from attachment to the seat frame 22 to a total length, T, e.g. about 41½ inches.

Figure 2:
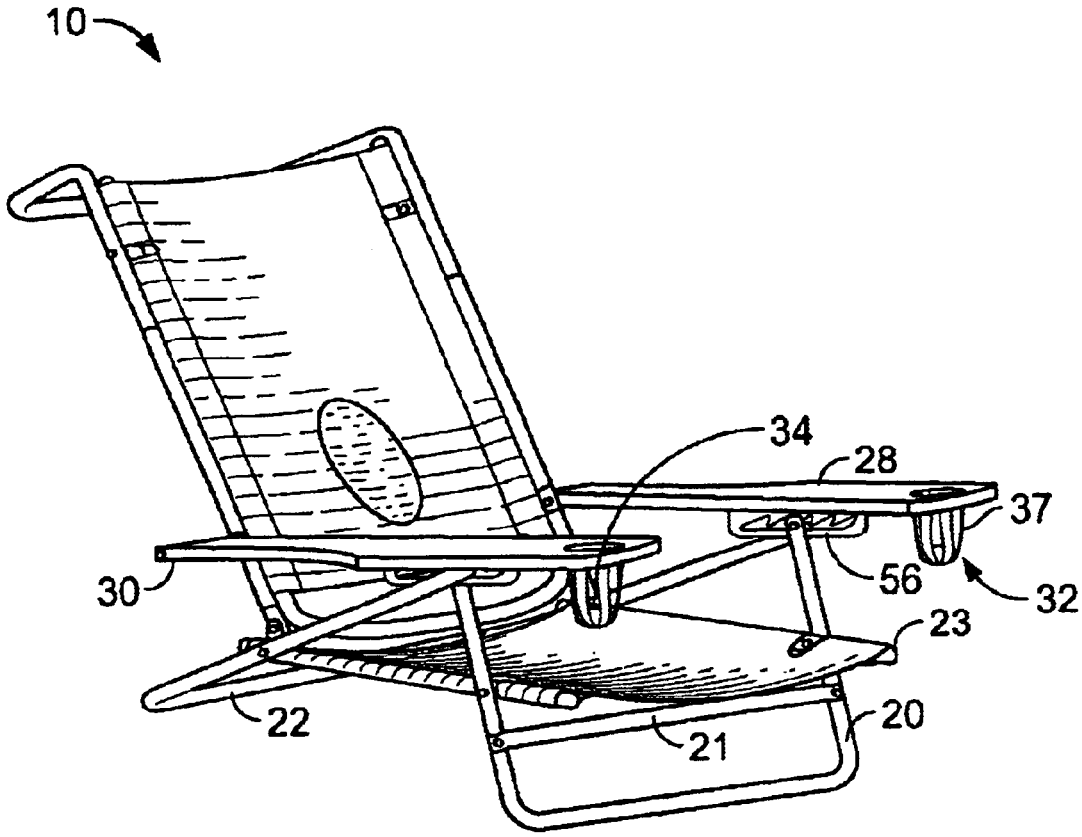
FIG. 2 is a perspective view of the folding sand beach chair of FIG. 1 with the seatback in upright (sitting) position.

Referring again to FIGS. 1 and 2, upon release of the armrests 28, 30 from the adjustable sawtooth-type engagement elements 56, 58, the setback 44 is pivotably adjusted (about axis, X) from its sitting position (FIG. 2) to its horizontal (prone) position (FIG. 1), with its crossbar portion 54 in engagement with the beach surface. (Selection of other, intermediate angular positions of the seatback 44 relative to the seat 42 are also permitted by the adjustable sawtooth-type engagement elements 56, 58.) The seatback extension 46 is pivotably adjustable between a folded position against the seat back 44 (FIG. 1) in upright position and an extended horizontal position (FIG. 2). The seatback extension 46 defines a central aperture, e.g. an oval opening or hole 60 having a major diameter of about 7 inches and a minor diameter of about 4½ inches. The aperture 60 is centered on the width of the seatback extension 46 and about two-thirds along its length, toward crossbar 27, for receiving the user's face in anatomically correct position when lying in the prone (face down) position, e.g. for sunning the back surface.

Figure 3:
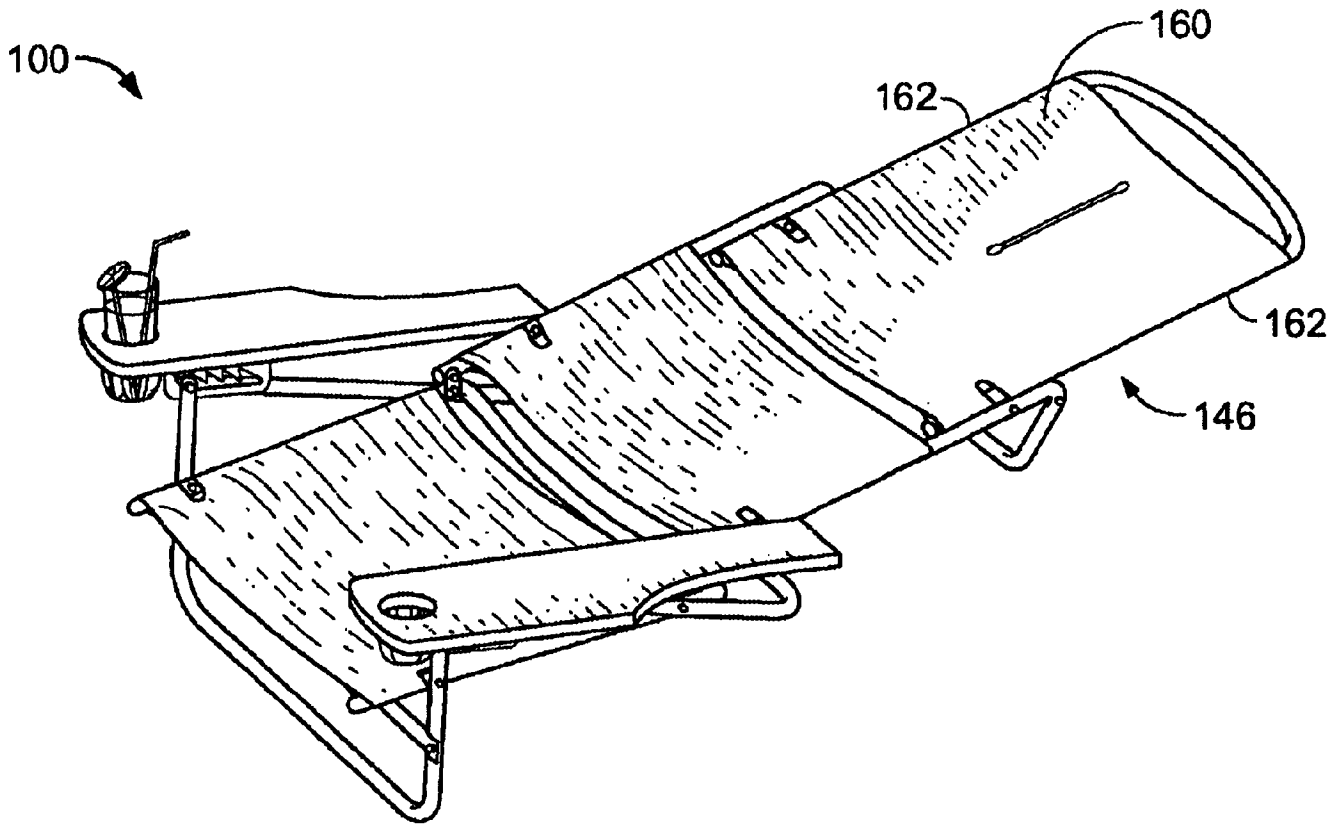
FIG. 3 is a perspective view of another embodiment of a folding sand beach chair of the invention with the seatback and extension in horizontal (prone) position.
Figure 4:
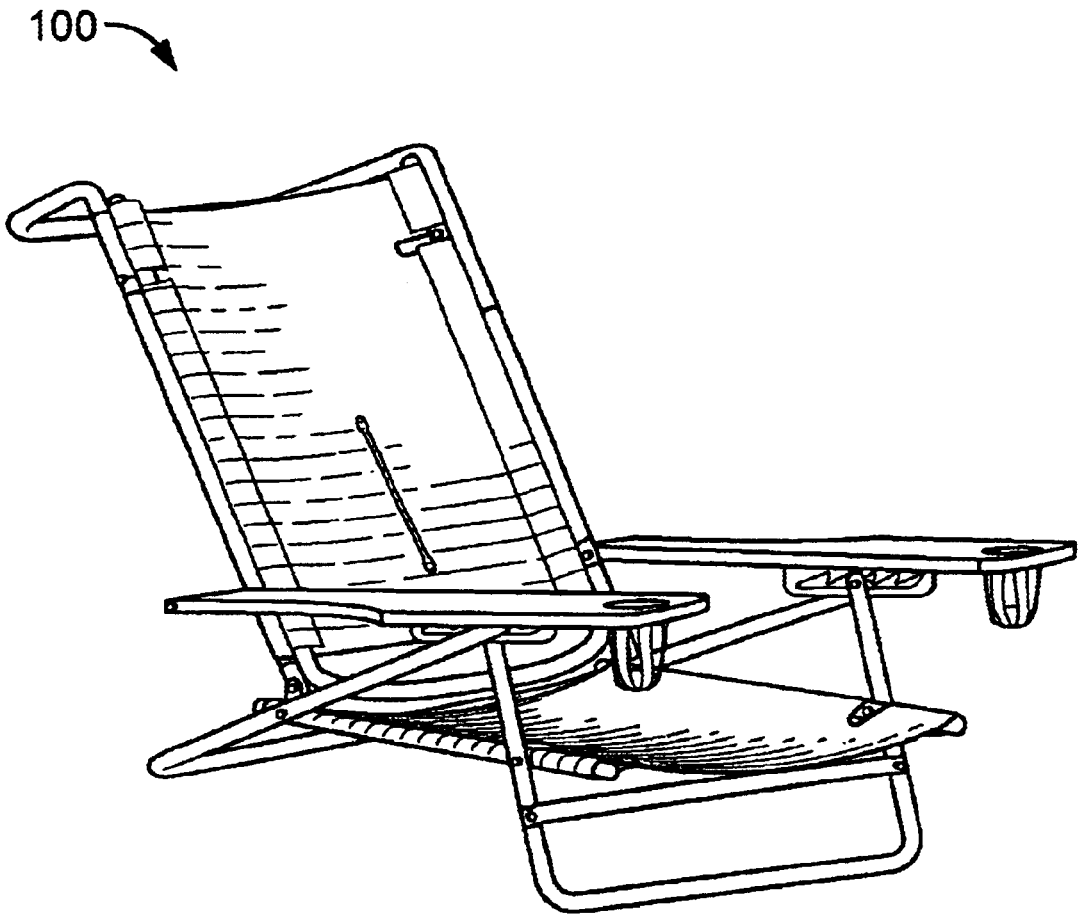
FIG. 4 is a perspective view of the folding beach chair of FIG. 3 with the seatback in upright (sitting) position.

Referring to FIGS. 3 and 4, in another embodiment of the folding sand beach chair 100 of the invention, the seatback extension 146 defines a central aperture 160 in the form of a slot about 9 inches long and 1 inch wide, with circular openings 162, each about 1.5 inches in diameter, at each end of the slot, for strength. Again, the slot-form aperture 160 is centered on the width of the seatback extension 146 and about two-thirds along its length, for receiving the user's face in anatomically correct position when lying in the prone (face down) position, e.g. for allowing sunning the user's back surfaces.

A number of embodiments of the invention have been described. Nevertheless, it will be understood that various modifications may be made without departing from the spirit and scope of the invention. Accordingly, other embodiments are within the scope of the invention.

What is claimed is:

1. A sand beach chair formed of panels mounted to a frame and comprising:

a seat, a seatback pivotably mounted to said seat for movement between a first, upright position and a second, horizontal position, and a seatback extension pivotably mounted to said seatback for selectable adjustment between a first, sitting position folded generally against said seatback to define, with said seatback, an extended, generally upright surface, and a second, horizontal position extending from said seatback to define, with said seat and seatback, an extended, generally horizontal surface.

2. The sand beach chair of claim 1, wherein a panel of said seatback extension defines an aperture positioned for receiving a user's face in anatomically correct position when lying in a prone position.

* * * * *